US009227306B2

(12) United States Patent
Pahng

(10) Patent No.: US 9,227,306 B2
(45) Date of Patent: Jan. 5, 2016

(54) RATCHETING TORQUE WRENCH HEAD

(71) Applicant: Stark Professional Tool, LLC, Green Oaks, IL (US)

(72) Inventor: Daniel Pahng, Green Oaks, IL (US)

(73) Assignee: Stark Professional Tool, LLC, Green Oaks, IL (US)

( * ) Notice: Subject to any disclaimer, the term of this patent is extended or adjusted under 35 U.S.C. 154(b) by 230 days.

(21) Appl. No.: 14/014,700

(22) Filed: Aug. 30, 2013

(65) Prior Publication Data

US 2015/0059536 A1 Mar. 5, 2015

(51) Int. Cl.
*B25B 13/46* (2006.01)
*B25B 13/08* (2006.01)

(52) U.S. Cl.
CPC ..... *B25B 13/46* (2013.01); *B25B 13/08* (2013.01)

(58) Field of Classification Search
CPC ..... B25B 13/08; B25B 13/12; B25B 13/18; B25B 13/46
USPC ..... 81/179, 186, 119
See application file for complete search history.

(56) References Cited

U.S. PATENT DOCUMENTS

| | | | | |
|---|---|---|---|---|
| 2,565,154 | A * | 8/1951 | Wedvik | 81/179 |
| 2,700,315 | A | 6/1955 | Hermanson | |
| 2,730,000 | A | 1/1956 | Crittenden, Jr. | |
| 2,795,160 | A | 6/1957 | Blasdell | |
| 2,879,681 | A | 3/1959 | Blasdell | |
| 3,023,654 | A | 3/1962 | Stambaugh et al. | |
| 3,165,015 | A | 1/1965 | Hinrichs | |
| 3,475,999 | A | 11/1969 | Roberts et al. | |
| 4,318,316 | A * | 3/1982 | Guilliams | 81/426.5 |
| 4,440,047 | A | 4/1984 | Robbins | |
| 4,776,244 | A * | 10/1988 | Olson et al. | 81/119 |
| 5,533,428 | A | 7/1996 | Pradelski | |
| 5,669,272 | A | 9/1997 | Hansen | |
| 5,768,958 | A | 6/1998 | Gamble | |
| 6,202,516 | B1 | 3/2001 | Kim | |
| 6,263,767 | B1 | 7/2001 | Hu | |
| 6,269,715 | B1 * | 8/2001 | Cagny | 81/119 |
| 7,077,035 | B1 | 7/2006 | Huang | |
| D686,473 | S * | 7/2013 | Nam | D8/28 |
| 2003/0196525 | A1 | 10/2003 | Huang | |
| 2004/0031359 | A1 * | 2/2004 | Kady | 81/179 |
| 2004/0255726 | A1 * | 12/2004 | Kady et al. | 81/165 |
| 2010/0050819 | A1 | 3/2010 | Nam | |
| 2011/0000343 | A1 | 1/2011 | Nam | |

* cited by examiner

*Primary Examiner* — Hadi Shakeri
(74) *Attorney, Agent, or Firm* — Andrus Intellectual Property Law, LLP

(57) ABSTRACT

A ratcheting wrench head for use with a torque wrench has spaced apart first and second jaws extending from a base portion to define an opening for accommodating a bolt or nut to be rotated. A ratchet member is movably mounted in a through hole formed in the second jaw between an outer surface and an inner surface of the second jaw. A biasing member is located in the through hole of the second jaw and forces the ratchet member against a portion thereof. Inner surfaces of the first jaw and the second jaw are particularly constructed to enhance ratcheting performance of the wrench head relative to the bolt or nut. The through hole is formed with a dirt slot for enabling removal of foreign material from the wrench head.

19 Claims, 5 Drawing Sheets

RATCHETING TORQUE WRENCH HEAD

BACKGROUND

The present disclosure relates generally to a hand tool and, more particularly, pertains to a ratcheting wrench head associated with a torque wrench for tightening or loosening a fastener, such as a bolt or a nut, without requiring separation of the wrench head from the fastener.

Wrenches are tools used to tighten or loosen bolts, nuts or the like, which are generally used when mechanical components are assembled or disassembled. Wrenches are classified into open-type wrenches and closed-type wrenches according to the shape of their heads, and open-type wrenches are classified into single open-type wrenches and double open-type wrenches. Specifically, the bolt or nut is tightened when a wrench is turned in one direction, and is loosened when the wrench is turned in an opposite direction.

In general, wrenches include a handle and a head. A handle is a type of bar that can be held by a user. A torque wrench is a special type of wrench that limits the amount of tightening force that can be applied to a bolt or nut. The torque wrench includes removable and replicable heads that can be used with different sized bolts or nuts. The head includes a base portion that extends from one end of the handle, and first and second jaws that extend in parallel from both ends of the base portion that face each other.

In regards to conventional wrenches, if a space sufficient to allow full 360-degree rotation of the handle is not available when the bolt or nut is tightened or loosened by being turned in the appropriate direction, a rotational stroke must be applied to the bolt or nut several times, and after each stroke is applied to the bolt or nut, the wrench must be repeatedly detached from the bolt or nut and returned to the initial position so as to apply another stroke.

In order to overcome the inconvenience of having to detach the wrench from the bolt or nut when a user applies sequential strokes in a particular direction, various ratchetable open-type wrenches have been developed in which one or both of the first and second jaws are provided with ratchet devices. These ratchetable open-type wrenches are currently not available for use with torque wrenches.

Unfortunately, known ratcheting wrenches continue to exhibit certain drawbacks in manufacturing and assembly which lead to decreased lifetime and problems in reliability of ratcheting performance in the wrenches. Such problems include cracking of the wrenches, faulty ratchet device operation due to accumulation of dirt and foreign particles therein, and lack of removability of the ratchet devices for replacement.

Accordingly, it is desirable to overcome the shortcomings of known ratcheting wrenches such as by improving the structure of the jaw design, providing for removal of accumulated foreign material and enabling access to and substitution of ratcheting components.

SUMMARY

The present disclosure relates to a hand tool including a ratcheting torque wrench head having a base portion provided with one end extending from a handle member, and an opposite end constructed with a first jaw and a second jaw that are spaced from each other. The first jaw and the second jaw together with the base portion define an opening adapted to accommodate a body to be rotated. The first jaw and the second jaw each have an inner surface and an outer surface. A ratchet member is movably mounted between the outer surface of only one of the first jaw and the second jaw and the inner surface of the one of the first jaw and the second jaw, and protrudes through the inner surface. A biasing member is located in the one of the first jaw and the second jaw, and normally forces the ratchet member in the direction of the base portion against a portion of the one of the first jaw and the second jaw. The inner surface of the other of the first jaw and the second jaw includes a first front planar portion and an angled surface rising upwardly and rearwardly therefrom at a first angle towards the outer surface of the other of the first jaw and the second jaw. The inner surface of the one of the first jaw and the second jaw includes a front planar portion and a rear planar portion extending upwardly and rearwardly therefrom toward the base portion at a second angle which is greater than the first angle.

The inner surface of the other of the first jaw and the second jaw further includes a first groove, a first protrusion and a second groove extending between and located above the angled surface and a first rear planar portion joined to the base portion. The first groove is formed by a circular wall, and the first rear planar portion extends rearwardly and downwardly from the second groove to an end wall of the base portion. The ratchet member is slidably mounted in a through hole formed in the one of the first jaw and the second jaw and extending between the outer surface thereof and the inner surface thereof. A lower portion of the through hole is formed with a dirt slot for removing foreign material which accumulates in the through hole. The biasing member has one end engaged against a front wall of the ratchet member, and an opposite end engaged against a cap disposed in and substantially blocking an outer end of the through hole except for the dirt slot. The cap is retained in the through hole by a removable retaining pin which extends through the one of the first jaw and the second jaw and the cap. The ratchet member has a rear wall engaged against the portion of the one of the first jaw and the second jaw, an upper wall including a ramped area and a chamfered surface which protrudes through the inner surface of the one of the first jaw and the second jaw, a lower wall and the front wall engaged by the biasing member. The cap includes a depending portion formed with an outer curved surface, and an extension projecting rearwardly from the depending portion and having an angled wall which lies coplanar with the inner surface of the one of the first jaw and the second jaw. The ratchet member is slidably mounted in the through hole beneath the extension of the cap.

The present disclosure also relates to a ratcheting torque wrench head including a base portion having one end joined to a handle member, and an opposite end provided with a first jaw and a second jaw that are spaced from each other. The first jaw and the second jaw each have an inner surface and an outer surface. A through hole is formed in only one of the first jaw and the second jaw passing through the one of the first jaw and the second jaw from the outer surface thereof to the inner surface thereof. A ratchet member is slidably mounted within the through hole and protrudes out of the inner surface of the one of the first jaw and the second jaw. A biasing member is located within the through hole and normally urges the ratchet member against a shoulder of the one of the first jaw and the second jaw. The through hole is formed with a dirt slot for removing foreign particles accumulating in the through hole through the outer surface of the one of the first jaw and the second jaw.

The dirt slot extends from the shoulder of the one of the first jaw and the second jaw to the outer surface of the one of the first jaw and the second jaw along a length of a bottom portion of the through hole. The biasing member has one end engaged against the ratchet member, and an opposite end engaged against a blocking member disposed in and obstructing an outer end of the through hole at the outer surface of the one of the first jaw and the second jaw except for the dirt slot. A hole formed in the blocking member and an aperture formed in the one of the first jaw and the second jaw are aligned, and receive a retaining pin passing therethrough to hold the blocking member in the through hole.

The present disclosure further relates to a ratcheting torque wrench head including a base portion having one end joined to a handle member, and an opposite end provided with a first jaw and a second jaw spaced apart from each other by an end wall of the base portion. The first jaw has a first inner surface and a first outer surface, and the second jaw has a second inner surface and a second outer surface. A through hole is formed in the second jaw and passes through the second jaw from the second outer surface to the second inner surface. A ratchet device is received and retained within the through hole and protrudes out of the second inner surface. The first inner surface includes a first front planar portion, an angled surface rising upwardly and rearwardly from the first front planar portion, a first groove connected to the angled surface and extending toward the first outer surface, a first protrusion joined to the first groove and extending toward the second inner surface, a second groove secured to the first protrusion and projecting toward the first outer surface and a first rear planar portion leading downwardly and rearwardly from the second groove to the end wall of the base portion. The second inner surface includes a second front planar portion and a second rear planar portion extending upwardly and rearwardly toward the end wall of the base portion.

BRIEF DESCRIPTION OF THE DRAWINGS

The best mode of carrying out the disclosure is described hereinbelow with reference to the following drawing figures.

DETAILED DESCRIPTION

Figure 1:
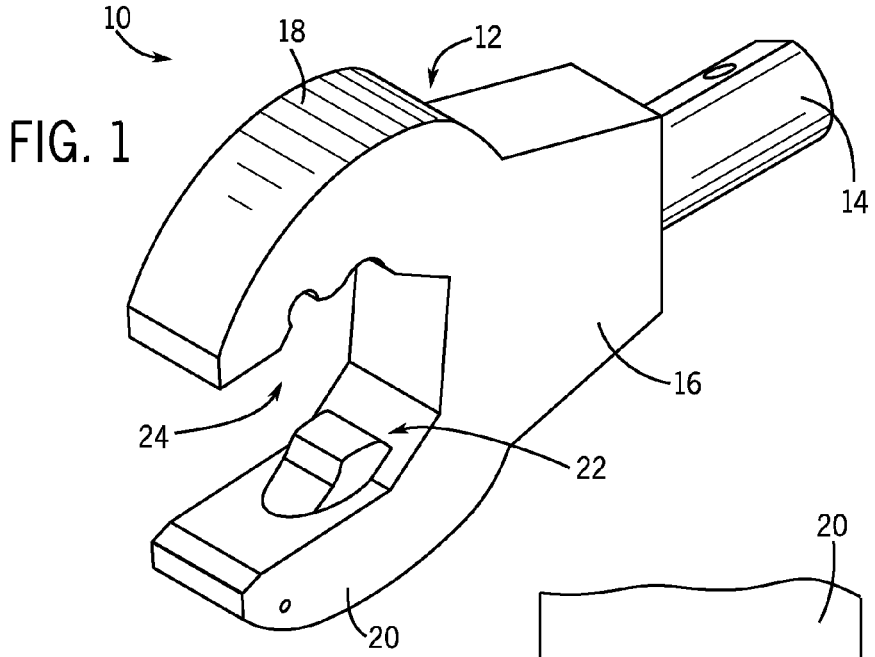
FIG. 1 is a top perspective view of a ratcheting torque wrench head in accordance with the present disclosure.

FIGS. 1-5 illustrate a ratcheting hand tool 10 used in a torque wrench to tighten a fastener by being turned in one direction, and to loosen the fastener by being turned in the opposite direction. The hand tool 10 is defined by a ratcheting open end torque wrench head 12 formed with an elongated handle connection 14 designed to be removably coupled to an elongated handle body (not shown). The wrench head 12 includes a base portion 16 attached at one end to the handle connection 14, and joined at an opposite end to a first jaw 18 and a second jaw 20 provided with a movable ratchet device 22. In the example shown in the drawings, the first jaw 18 has a length which extends slightly beyond a length of the second jaw 20. The jaws 18, 20 are spaced apart and shaped to form an opening 24 for accommodating a head portion of a body 26, such as a nut or bolt, to be rotated such as depicted in FIGS. 6-11. As will be described in more detail hereafter, certain side edges 28*a*-28*f* and apices 30*a*, 30*f* of the body 26 are engaged and confined in the opening 24 by the first jaw 18 and the ratchet device 22 mounted in the second jaw 20. In the exemplary embodiment, the first jaw 18 typically refers to a portion on which a tensile force is exerted as the wrench head 12 is turned to tighten the bolt or nut, and the second jaw 20 typically refers to a portion on which a compression force is exerted.

Figure 4:
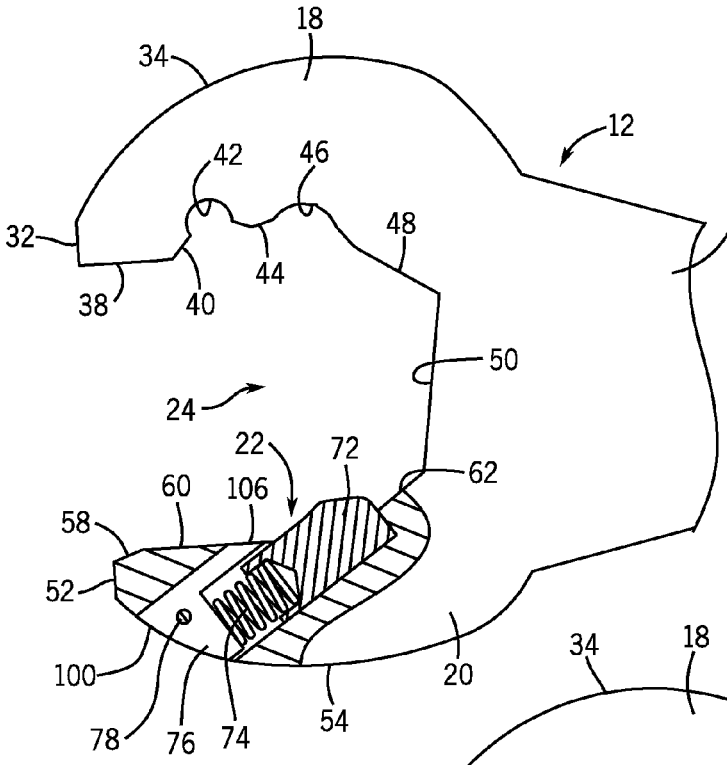
FIG. 4 is a view of the ratcheting torque wrench head of FIG. 1 illustrating a ratcheting member in partial cross-section.
Figure 5:
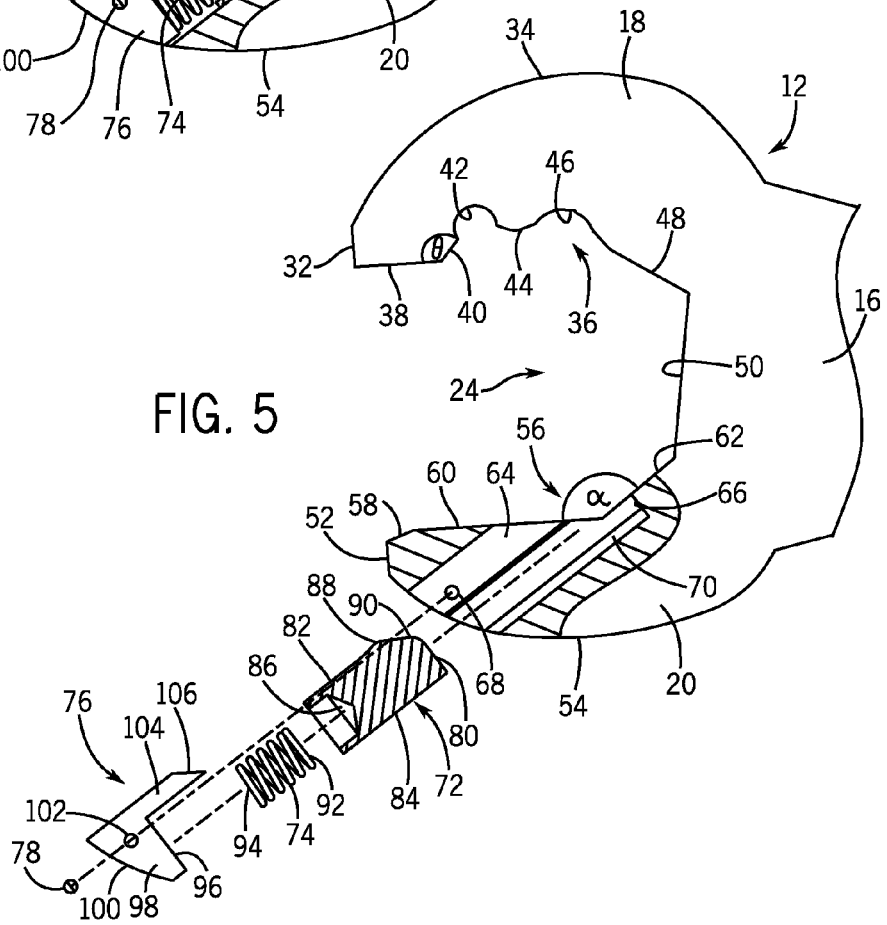
FIG. 5 is an exploded view of FIG. 4.

As best seen in FIGS. 4 and 5, the first jaw 18 has a generally vertically extending first flat front nose 32 connected between a first outer surface 34 and a first inner surface 36. The first outer surface 34 is continuously curved, and extends rearwardly into the base portion 16. The first inner surface 36 includes a first front planar portion 38, an angled surface 40, a first groove 42, a first protrusion 44, a second groove 46 and a first rear planar portion 48.

The angled surface 40 extends upwardly and rearwardly from a rear edge of the front planar portion 38 and projects toward the outer edge 34. An upper end of the angled surface 40 leads into the first groove 42 which is defined by a circular wall that extends upwardly above the angled surface 40. The first protrusion 44 projects inwardly toward an upper region of the opening 24, and is positioned between a rear end of the first groove 42 and a front end of the second groove 46. The second groove 46 rises upwardly towards the outer surface 34, and has a rear end which merges into the rear planar portion 48. The rear planar portion 48 slopes downwardly and rearwardly beneath the front planar portion 38, and terminates at a flat end wall 50 of base portion 16. The first groove 42, the first protrusion 44 and the second groove 46 are all located above the angled surface 40 and the rear planar portion 48.

The second jaw 20 has a generally vertically extending second front nose 52 joined between a second outer surface 54 and a second inner surface 56. The second outer surface 54 is continuously curved, and progresses rearwardly into the base portion 16. The second inner surface 56 includes a front beveled surface 58, a second front planar portion 60, and a second rear planar portion 62.

The front beveled surface 58 connects the second front nose 52 with the second front planar surface 60 which lies generally parallel to the first front planar surface 38 of the first jaw 18. The second rear planar portion 62 angles upwardly and rearwardly from the second front planar portion 60 and terminates at the end wall 50 of the base portion 16. As seen in FIG. 5, the rear planar portion 62 on the second jaw 20 rises upwardly and rearwardly from the front planar portion 60 at an angle $\alpha$ which is greater than the angle $\theta$ at which angled surface 40 extends upwardly and rearwardly from the front planar portion 38 on the first jaw 18.

Figure 3:
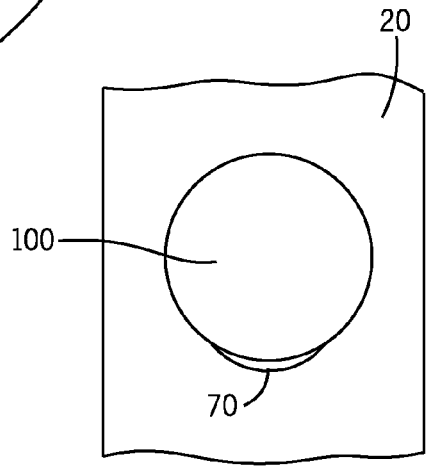
FIG. 3 is an enlarged detail view of the ratcheting torque wrench head taken on line 3-3 of FIG. 2.
Figure 2:
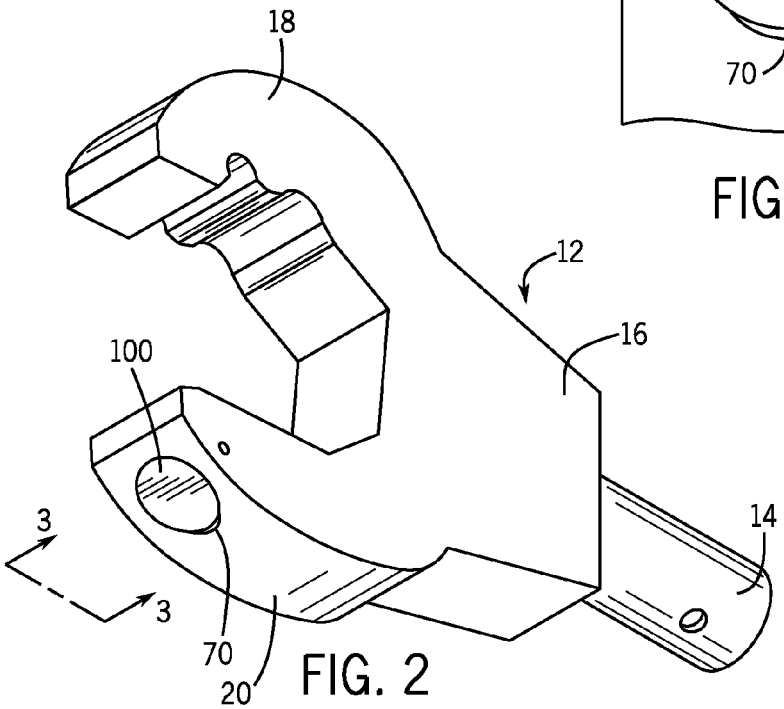
FIG. 2 is a bottom perspective view of the ratcheting torque wrench head shown in FIG. 1.

The second jaw 20 is formed with a through hole 64 which extends from the second outer surface 54 proximal the front or outer end of the second jaw 20 to the second planar portion 60 and the second rear planar portion 62 near the base portion 16. That is, the through hole 64 is elongated from the front end of the second jaw 20 towards the base portion 16, and is shaped to receive and retain the ratchet device 22. The through hole 64 is configured with a shoulder 66 which defines a stop wall in the second jaw 20 for limiting the inward extent of movement of a portion of the ratchet device 22. An aperture 68 extends transversely through the second jaw 20 and intersects the through hole 64. In addition, the lower portion of the through hole 64 is formed along its entire length with a dirt trough or slot 70, as seen in FIGS. 2, 3 and 5, which extends from the shoulder 66 and leads out the second outer surface 54 at the front or outer end of the second jaw 20. The dirt slot 70 is designed to permit any dirt or foreign material which may accumulate in the through hole 64 during ratcheting operation to be released outside the wrench head 12 as will be further described below.

Referring to FIGS. 4 and 5, the ratchet device 22 is comprised of a ratchet member 72, an elastic pressure or biasing member such as a spring 74, a blocking member or cap 76 and a retaining pin 78.

The ratchet member 72 has a planar rear wall 80, an upper wall 82, a lower wall 84 and a recessed front wall 86. The rear wall 80 is engagable and disengagable with the shoulder 66 in the second jaw 20. The upper wall 82 is slightly ramped upward at 88 as it extends along its length, and includes a downwardly and rearwardly chamfered surface 90 which terminates at the rear wall 80. The lower wall 84 is flat and slides back and forth along the bottom wall defining the through hole 64.

The elastic pressure or biasing member 74 is typically a coil spring, but may be formed of any suitable element which is compressible and extensible, such as elastic rubber. The spring 74 has a rear end 92 which is received and retained in the recessed front wall 86 of the ratchet member 72. A front end 94 of the spring is engaged against an inner wall 96 of a depending portion 98 of the cap 76. The depending portion 98 has a curved outer surface 100 and is formed transversely therethrough with a small hole 102 sized to receive the retaining pin 78. The cap 76 also includes an extension 104 which projects rearwardly from an upper end of the depending portion 98 and terminates in an angled wall 106.

In assembly, the ratchet member 72 followed by the spring 74 and the cap 76 are slidably inserted into the through hole 64 from the outer surface 54 of the second jaw 20 until the rear wall 80 abuts the shoulder 66, and the aperture 68 in the second jaw 20 is aligned with the hole 102 in the cap 76. At this point, the ratchet device 22 is retained in position by inserting the retaining pin 78 through the aligned aperture 68 and the hole 102.

Figure 10:
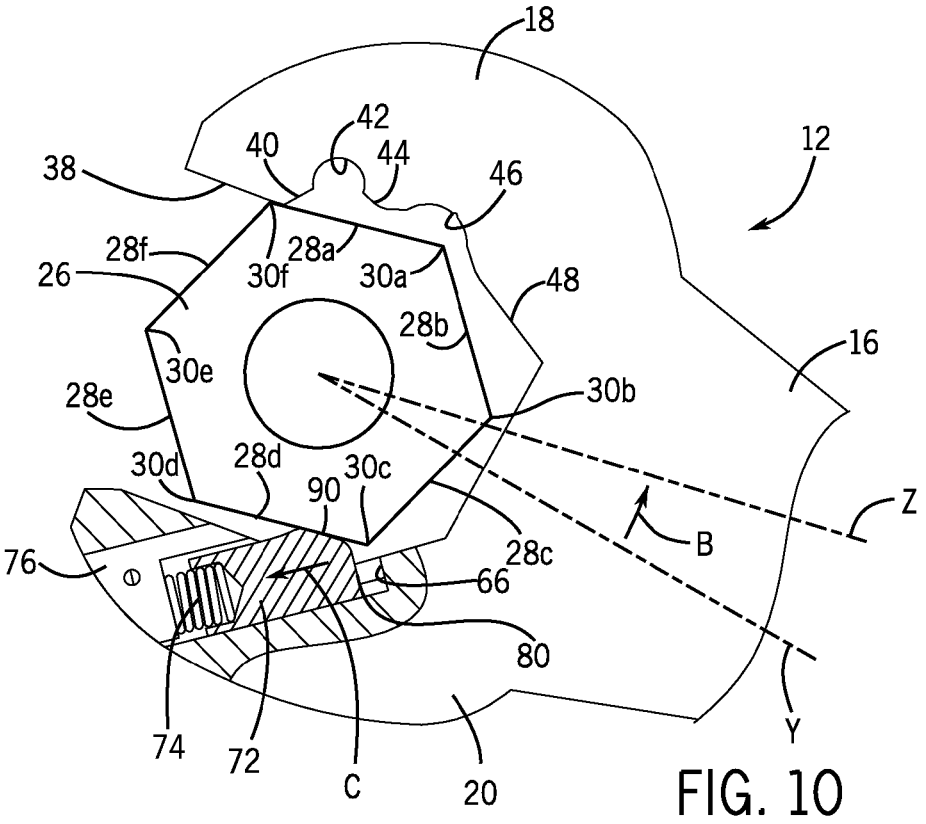

When fully assembled, the curved outer surface 100 of the cap 76 lies substantially flush with the outer surface 54 of the second jaw 20, and blocks the outer end of the through hole 64 except for the exposure of dirt slot 70 as best seen in FIG. 3. In addition, the angled wall 106 of the cap 76 and the second planar portion 60 of the second jaw 20 are coplanar. A front end of the ratchet member 72 is received between the extension 104 of the cap 76 and the lower wall of through hole 64. Referring to FIG. 4, the spring 74 normally biases the ratchet member 72 so that the rear wall 80 thereof contacts shoulder 66 of the second jaw 20. A portion of upper wall 82, the ramped area 88 and the chamfered surface 90 are exposed in the wrench head opening 24. The ratchet member 72 is slidably movable within the through hole 64 over a limited distance, as depicted in FIG. 10, upon application of a force which overcomes the biasing force of spring 74.

In use, the wrench head 12 is used with a torque wrench to tighten and loosen a body, such as a bolt or nut, so that while turning the wrench head 12 alternately in opposite directions forwards and backwards, the relative position of the bolt or nut engaged by the wrench head 12 may be fixed and the wrench head 12 does not have to be separated from the bolt or nut for each turn of alternate direction. The body of the torque wrench limits the amount of force that can be applied to the bolt or nut in a conventional fashion.

FIGS. 6-11 depict a typical ratcheting operation of the wrench head 12 when it is desired to tighten a body 26 (bolt or nut) having a polygonal gripping portion.

Figure 6:
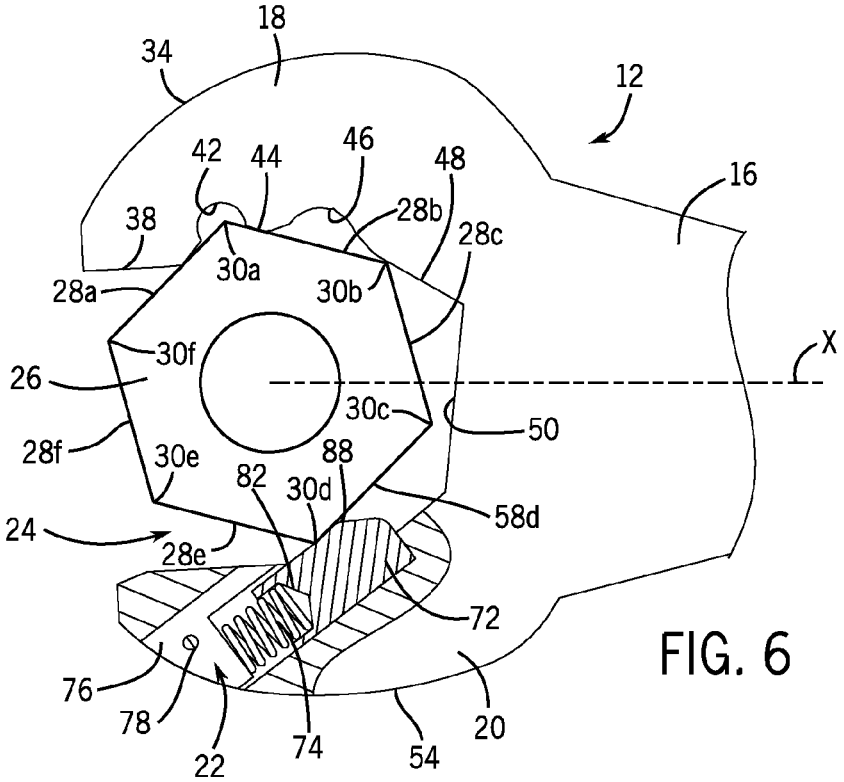
FIGS. 6-11 illustrate various operations of the ratcheting torque wrench head with a body to be rotated.

FIG. 6 shows the body 26 initially engaged by the wrench head 12 such that a portion of side edge 28*a* contacts angled surface 40. Apex 30*a* is located in the cavity defined by the first groove 42, and the portion of side edge 28*b* interfaces with protrusion 44. Apex 30*b* engages rear planar portion 48, a portion of the side edge 28*d* abuts the ramped area 88 and apex 30*d* lies against upper wall 82 of ratchet member 72. The dotted line x represents a generally horizontal reference line passing through the center of body 26.

Figure 7:
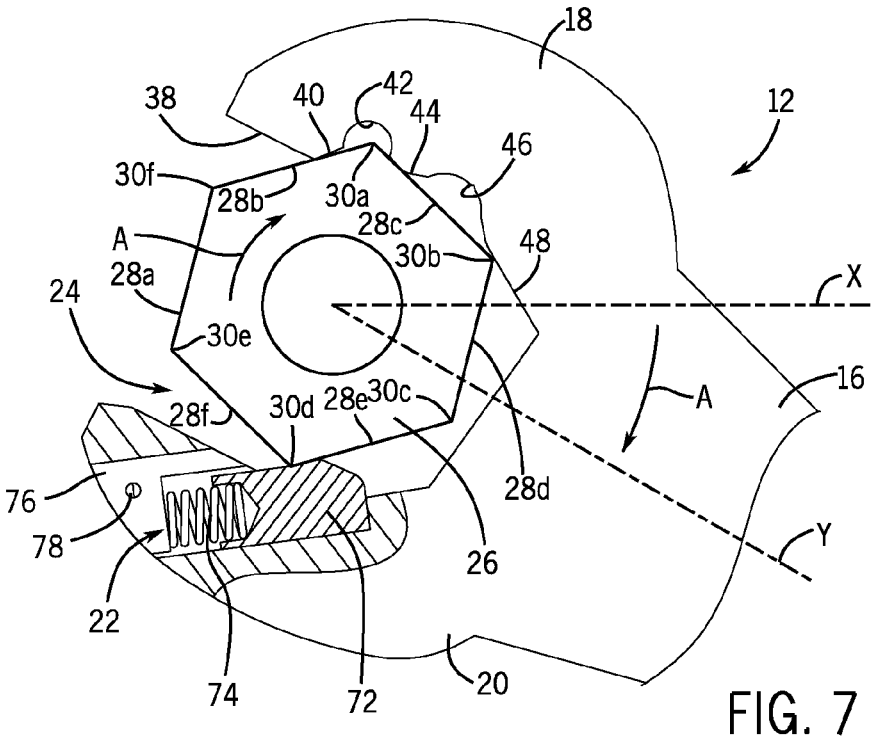

FIG. 7 shows a wrench head 12 turned in a clockwise direction designated by arrow A over an angle of rotation from reference line x to a reference line y to tighten the body 26. That is, the body 26 is rotated together with the wrench head 12 in the direction of arrow A. During rotation, the spring 74 holds the ratchet member 72 against the shoulder 66 of second jaw 20.

Figure 8:
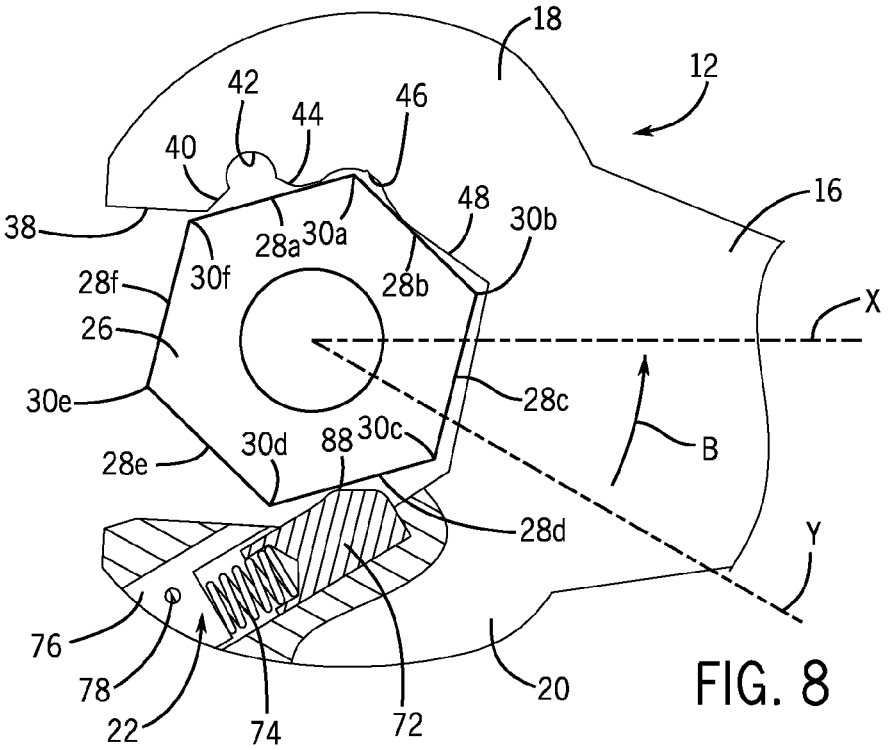

FIG. 8 shows the wrench head 12 turned in a counterclockwise direction designated by arrow B over an angle of rotation from reference line y back to the reference line x such that the wrench head 12 is allowed to rotate relative to the body 26 which remains fixed in the position of FIG. 7. As the wrench head 12 rotates relative to the body 26, a portion of side edge 28*a* engages protrusion 44, apex 30*a* is directed into the cavity defined by second groove 46 and a portion of side edge 28*b* contacts rear planar portion 48. A portion of side edge 28*d* contacts ramped area 88 of ratchet member 72.

Figure 9:
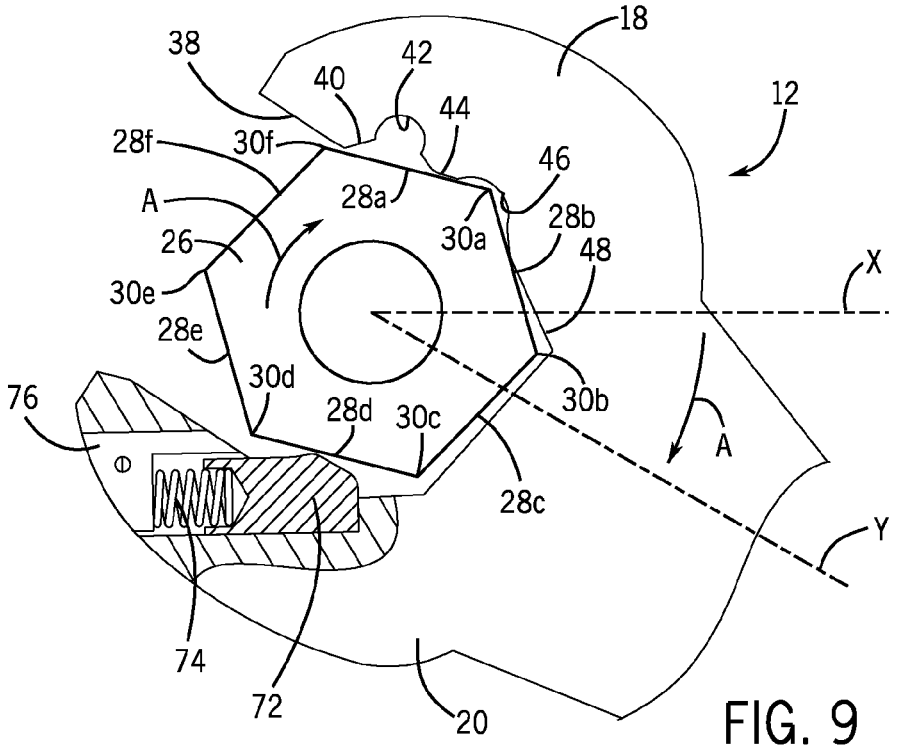

FIG. 9 shows the wrench head 12 again turned in a clockwise direction represented by arrow A to further tighten the body 26 over the angle of rotation of reference line x to reference line y while maintaining the engagement of the jaw and body surfaces shown in FIG. 8.

FIG. 10 shows the wrench head 12 with rotation reversed in the counterclockwise direction of arrow B over an angle of rotation from reference line y to reference line z such that the wrench head 12 is allowed to rotate relative to the body 26 which remains in the fixed position of FIG. 9. As the wrench head 12 rotates relative to the body 26, a portion of the side edge 28*a* adjacent apex 30*f* engages front planar portion 38. At the same time, a portion of side edge 28*d* contacts the chamfered surface 90 of ratchet member 72 with a force which overcomes the biasing force of spring 74, and causes the rear wall 80 of ratchet member 72 to move away from shoulder 66 in the direction of arrow C.

Figure 11:
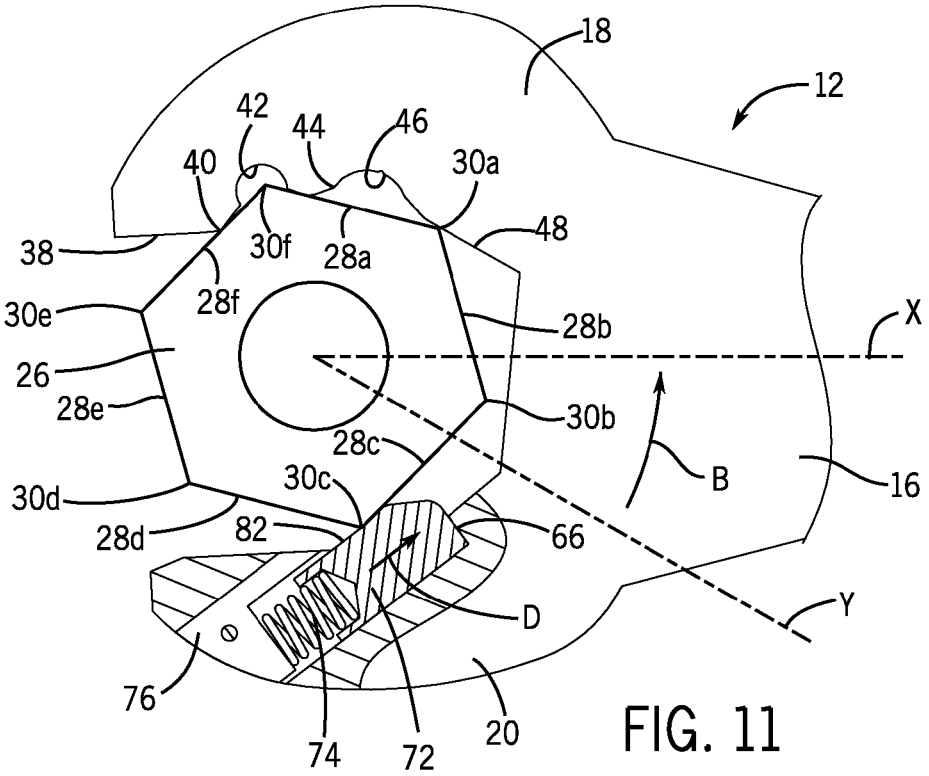

FIG. 11 shows continued rotational movement of the wrench head 12 in the counterclockwise direction of arrow B over an angle of rotation back to reference line x such that the wrench head 12 continues to rotate relative to the fixed body 26 positioned as shown in FIG. 10. During this movement, the wrench head 12 returns to the position illustrated in FIG. 6 with the body 26 having been partially turned and tightened. In the example shown, the body 26 is typically turned through a 60-degree rotational movement. During the wrench head movement shown in FIG. 11, angled surface 40 rides over apex 30*f* and is guided into contact with a portion of side edge 28*f*. Simultaneously, apex 30*f* is directed into the first groove 42, a portion of side edge 28*a* contacts protrusion 44 and apex 30*a* engages rear planar portion 48. Also, the ratchet member 72 slides relative to apex 30*c* and disengages from side edge 28*d* to enable the spring 74 to return the ratchet member 72 in the direction of arrow D against the shoulder 66 of second jaw 20. At this point, a portion of side edge 28*c* contacts the upper wall 82 and ramped area 88 of ratchet member 72.

Similar rotational movement of the wrench head 12 will cause further tightening of the body 26. Loosening of the body 26 can be effected by turning the wrench head 12 in opposite directions from those shown in the examples of FIGS. 6-11.

It should be appreciated that a desirable ratcheting movement of the wrench head 12 is aided by the particular formation of the inner surface 36 of the first jaw 18. More specifically, the first planar portion 38, the angled surface 40, the protrusion 44 and the rear planar portion 48 provide engagement surfaces for the body 26 to be rotated. For example, the relationship between the front planar portion 38 and the angled surface 40 provides for an effective leading driving engagement between the first jaw 18 and the body 26. The retaining pin 78 may be removed if necessary to replace one or more parts of the ratchet device 22. Any dirt or foreign particles which may be deposited through the through hole 64 during normal ratcheting operation can exit via the dirt slot 70 out the front or outer end of the second jaw 20 beneath the curved outer surface 100 of cap 76.

Various alternatives are contemplated as being within the scope of the following claims particularly pointing out and distinctly claiming the subject matter regarded as the invention.

What is claimed is:

1. A ratcheting wrench head comprising:

a base portion provided with one end extending from a handle member, and an opposite end constructed with a first jaw and a second jaw that are spaced from each other, and together with the base portion, define an opening adapted to accommodate a body to be rotated, the first jaw and the second jaw each having an inner surface and an outer surface;

a ratchet member movably mounted between the outer surface of only one of the first jaw and the second jaw and the inner surface of the one of the first jaw and the second jaw and protruding through the inner surface;

a biasing member located in the one of the first jaw and the second jaw and normally forcing the ratchet member in the direction of the base portion against a portion of the one of the first jaw and the second jaw;

wherein the inner surface of the other of the first jaw and the second jaw includes a first front planar portion and an angled surface rising upwardly and rearwardly therefrom at a first angle towards the outer surface of the other of the first jaw and the second jaw; and wherein the inner surface of the one of the first jaw and the second jaw includes a front planar portion and a rear planar portion extending upwardly and rearwardly therefrom towards the base portion at a second angle which is greater than the first angle.

2. The wrench head of claim 1, wherein the inner surface of the other of the first jaw and the second jaw further includes a first groove, a first protrusion and a second groove extending between and located above the angled surface and a first rear planar portion joined to the base portion.

3. The wrench head of claim 2, wherein the first groove is formed by a circular wall and the first rear planar portion extends rearwardly and downwardly from the second groove to an end wall of the base portion.

4. The wrench head of claim 1, wherein the ratchet member is slidably mounted in a through hole formed in the one of the first jaw and the second jaw, and extends between the outer surface thereof and the inner surface thereof.

5. The wrench head of claim 4, wherein a lower portion of the through hole is formed with a dirt slot for removing foreign material which accumulates in the through hole.

6. The wrench head of claim 4, wherein the biasing member has one end engaged against a front wall of the ratchet member, and an opposite end engaged against a cap disposed in and substantially blocking an outer end of the through hole except for a dirt slot.

7. The wrench head of claim 6, wherein the cap is retained in the through hole by a removable retaining pin which extends through the one of the first jaw and the second jaw and the cap.

8. The wrench head of claim 6, wherein the ratchet member has a rear wall engaged against a shoulder of the one of the first jaw and the second jaw, an upper wall including a ramped area and a chamfered surface which protrudes through the inner surface of the one of the first jaw and the second jaw, a lower wall and the front wall engaged by the biasing member.

9. The wrench head of claim 6, wherein the cap includes a depending portion formed with an outer curved surface, and an extension projecting rearwardly from the depending portion and having an angled wall which lies coplanar with the inner surface of the one of the first jaw and the second jaw.

10. The wrench head of claim 9, wherein the ratchet member is slidably mounted in the through hole beneath the extension of the cap.

11. A ratcheting wrench head for use with a torque wrench comprising:

a base portion having one end joined to a handle member and an opposite end provided with a first jaw and a second jaw that are spaced from each other to define an opening to accommodate a body to be rotated, the first jaw and the second jaw each having an inner surface and an outer surface;

a through hole formed in the second jaw and passing through the second jaw from the outer surface thereof to the inner surface thereof;

a ratchet member slidably mounted within the through hole and protruding out of the inner surface of the second jaw;

a biasing member located within the through hole and normally urging the ratchet member against a shoulder of the second jaw at one end and engaging a blocking member at an opposite end;

a dirt slot formed below and open to the through hole and extending through the second jaw from the outer surface and open to the opening through the inner surface for removing foreign particles accumulating in the through hole through the outer surface of the second jaw; and wherein a hole formed in the blocking member and an aperture formed in the second jaw are aligned, and receive a retaining pin passing therethrough to hold the blocking member in the through hole.

12. The ratcheting wrench head of claim 11, wherein the dirt slot extends from the shoulder of the second jaw to the outer surface of the second jaw along a length of a bottom portion of the through hole.

13. The ratcheting wrench head of claim 12, wherein the blocking member is disposed in and obstructing an outer end of the through hole at the outer surface of the second jaw except for the dirt slot.

14. A ratcheting wrench head for use with a torque wrench comprising:

a base portion having one end joined to a handle member, and an opposite end provided with a first jaw and a second jaw spaced apart from each other by an end wall of the base portion, the first jaw having a first inner surface and a first outer surface, the second jaw having a second inner surface and a second outer surface;

a through hole formed in the second jaw and passing through the second jaw from the second outer surface to the second inner surface;

a ratchet device received and retained within the through hole and protruding out of the second inner surface;

wherein the first inner surface includes a first front planar portion, an angled surface rising upwardly and rearwardly from the first front planar portion, a first groove connected to the angled surface and extending toward the first outer surface, a first protrusion joined to the first groove and extending towards the second inner surface, a second groove secured to the first protrusion and projecting toward the first outer surface, and a first rear planar portion leading downwardly and rearwardly from the second groove to the end wall of the base portion; and wherein the second inner surface includes a second front planar portion and a second rear planar portion extending upwardly and rearwardly toward the end wall of the base portion.

15. The ratcheting wrench head of claim 14, wherein the first groove, the first protrusion and the second groove are located above the angled surface and the rear planar portion.

16. The ratcheting wrench head of claim 14, wherein the angled surface slopes relative to the first front planar portion at a first angle, and the second rear planar portion slopes relative to the second front planar portion at a second angle which is greater than the first angle.

17. The ratcheting wrench head of claim 14, wherein the through hole is formed with a dirt slot depending therefrom and extending from a shoulder of the second jaw to an outer surface of the second jaw.

18. The ratcheting wrench head of claim 14, wherein the ratchet device provides a ratchet member slidably mounted in the through hole and protruding through the second inner surface, a cap disposed in the through hole and blocking an outer end of the through hole at the second outer surface except for a dirt slot, a biasing member positioned between the ratchet member and the cap, and a retaining pin extending through the cap and the second jaw.

19. The ratcheting wrench head of claim 14, wherein the first front planar portion lies parallel to the second front planar portion.

* * * * *